US007891971B2

(12) United States Patent
Schmidt et al.

(10) Patent No.: US 7,891,971 B2
(45) Date of Patent: Feb. 22, 2011

(54) COMBUSTION HEAD AND METHOD FOR COMBUSTING FUEL

(75) Inventors: Thomas Schmidt, Pirna (DE); Urte Donnerstag, Pirna (DE); Hans-Jurgen Stittrich, Pirna (DE)

(73) Assignee: Elco Burners GmbH, Pirna (DE)

( * ) Notice: Subject to any disclaimer, the term of this patent is extended or adjusted under 35 U.S.C. 154(b) by 839 days.

(21) Appl. No.: 11/502,501

(22) Filed: Aug. 10, 2006

(65) Prior Publication Data

US 2007/0042308 A1 Feb. 22, 2007

(30) Foreign Application Priority Data

Aug. 16, 2005 (DE) ..... 10 2005 038 662

(51) Int. Cl.
*F23C 5/00* (2006.01)

(52) U.S. Cl. ..... 431/9; 431/8; 431/12; 431/116

(58) Field of Classification Search ..... 431/9, 431/12, 8, 115, 116, 173, 181, 185, 187
See application file for complete search history.

(56) References Cited

U.S. PATENT DOCUMENTS 5,015,174 A 5/1991 Dreizler et al.
5,299,930 A * 4/1994 Weidman ..... 431/10

FOREIGN PATENT DOCUMENTS

DE 195 09 219 C2 7/2003
EP 0 347 834 B1 5/1993
EP 0 635 676 B1 9/1997
EP 0 857 915 B1 6/2002

OTHER PUBLICATIONS

"Die Weishaupt Neuheiten 2001", Max Weishaupt GmbH, Printing No. 38002001, Mar. 2001, 44 pages (with 3-page English translation of pertinent parts).
"Montage- und Betriebsanleitung Weishaupt-Gasbrenner Baugrößen 30 bis 70", Max Weishaupt GmbH, Printing No. 830550201, Jan. 1998, 40 pages (with 6-page English translation of pertinent parts).
"Technology Trends—Large Burners", presentation by Dr. Lück, Max Weishaupt GmbH, at 3rd European Conference on Small Burner Technology in Aachen, Germany, Sep. 17, 2003, 19 pages.
"Weishaupt multiflam® Öl- und Zweistoffbrenner bis zu 12MW", Max Weishaupt GmbH, Printing No. 83204101, Mar. 2003, 12 pages (with 3-page English translation of pertinent parts).
"Weishaupt Zweistoffbrenner WKGL70", Max Weishaupt GmbH, Printing No. 83204601, Dec. 2004, 8 pages (with 6-page English translation of pertinent parts).
"Weishaupt-Gasbrenner Typ G30 bis G70 Ausführung LN (Low-NOx) Zusatzblatt zur Montage- und Betriebsanleitung Druck-Nr. 502", Max Weishaupt GmbH, Printing No. 83049701, Jan. 1999, 8 pages (with 2-page English translation of pertinent parts).
Klaus Lück et al., "Der multiflame® von Weishaupt: Innovative LowNOx-Technik für Ölbrenner", Wärmetechnik, vol. 45 (2000), 3 pages (with 5-page English translation).

* cited by examiner

*Primary Examiner*—Alfred Basichas

(57) ABSTRACT

Combustion head and method for combusting liquid and/or gaseous fuel having a flame front distanced downstream from the combustion head, in which fuel is discharged in a downstream direction radially outward at an angle at the end of the combustion head located downstream toward at least several guide devices and into a combustion chamber.

32 Claims, 2 Drawing Sheets

COMBUSTION HEAD AND METHOD FOR COMBUSTING FUEL

FIELD OF THE INVENTION

The present invention relates generally to a combustion head and method by which a flame front located at a distance from the combustion head is generated downstream in a combustion chamber with the combustion of gaseous and/or liquid fuels.

BACKGROUND OF THE INVENTION

In the combustion of fossil fuels in firing plants, environmentally harmful pollutant emissions are created, particularly in the form of nitrogen oxides (e.g. NO, $NO_2$), which are usually described collectively as NOx. Pollutant emissions can be affected and/or reduced by steps taken in the design in firing plants, particularly in the burners used therein.

In the case of nitrogen oxides, the recirculation of exhaust gases created during combustion has proved to be effective. Recirculated exhaust gases lower the flame temperature so that the quantity of nitrogen oxides that are created at high combustion temperatures is reduced.

DE 195 09 219 discloses a method and a burner head in which fuel gas is combusted while combustion air is supplied, with inert gas to reduce nitrogen oxides, where the fuel gas is blown in relative to the combustion air on two levels lying one behind the other in the direction of airflow, with an overstoichiometric combustion air/fuel gas mixture on the first level upstream from the flame at the flame root, and with supplemental fuel gas supply in the second plane, and where recirculated exhaust gas serves as inert gas which is supplied on the second level, and one part of the combustion gases blown in on the second level forms an understoichiometric mixture with the recirculating exhaust gas before the mixture is brought to the flame.

EP 0 347 834 discloses a burner head for a forced-draft gas burner having a burner tube containing a device for distributing the fuel gas and the combustion air and also fuel gas nozzles and air passages and having a flame tube adjoining the burner tube, where at least one radial opening for exhaust gas recirculation is present between burner tube and flame tube, and, in the root area of the flame between burner tube and flame tube upstream from the radial opening but downstream from the fuel gas nozzles and air passages, webs are provided projecting radially inward transverse to the burner head longitudinal axis.

EP 0 635 676 discloses a method for the low-NOx combustion of liquid or gaseous fuels in firing plants with a burner projecting into a combustion chamber of a boiler, whose burner tube has at least one fuel nozzle located therein to supply the fuel and an adjacent baffle plate, in which method a considerable portion of the fuel is supplied to an area downstream from the baffle plate and adjacent to the inner wall of the burner tube, exhaust gases present in the combustion chamber are brought back through internal recirculation into negative pressure areas in the burner tube which build up downstream from the baffle plate and one or more guide elements pierce the burner tube and project into the negative pressure areas.

EP 0 857 915 discloses a method for combusting liquid and/or gaseous fuels with a combustion head of a burner projecting into the combustion chamber of a boiler, the flame tube of the burner having at least one atomizer nozzle located therein for the supply of fuel and a swirl body, where a portion of the air stream for combustion is led through a swirl body, negative pressure is generated at the section of the flame tube located downstream by guide devices and openings in the flame tube, the exhaust gas from combustion is mixed with the combustion air, the exhaust gas is mixed with the atomized but not yet ignited fuel, and a flame front is generated at a distance from the combustion head.

Overall, it can be said that known approaches are not adequate to meet the increased requirements for emissions resulting from the operation of firing plants, in particular to achieve the low nitrogen oxide limits which are required, for example, by law.

OBJECT OF THE INVENTION

The object of the invention is to reduce further the pollutants created during the combustion of fuels, principally emissions of NOx, compared with known approaches, in particular to enable higher combustion chamber pressures with the lowest possible level of emissions.

BRIEF DESCRIPTION OF THE INVENTION

According to one aspect, the invention presents a combustion head and method for combusting fuel in accordance with the primary claims to achieve this object. Additional aspects and features of the invention can be found in the dependent claims, the subsequent description of embodiments and the attached drawings.

The combustion head from the invention is designed to combust liquid and/or gaseous fuels downstream with a flame front located at a distance from the combustion head. In contrast to conventional combustion heads, in which a flame front develops essentially directly at areas of the combustion head located downstream, a flame front is created during operation by means of the combustion head from the invention which is positioned in a combustion chamber distanced from the combustion head and stabilizes itself "freely" ahead of the combustion head in the combustion chamber.

The combustion head comprises a burner tube which has an open end located downstream, intended for location in a combustion chamber, at least one guide device located at the end positioned downstream which extends radially inward at a first angle, i.e. at an angle between 0° and 90° in the direction of the burner tube axis, and one or more fuel nozzles located in the burner tube.

Preferably, several guide devices are provided which are at a distance from each other and extend radially inward at the first angle and in the downstream direction.

In a further embodiment, the or each guide device can extend radially inward at the first angle and in a perpendicular direction to the burner tube axis or radially inward at the first angle and in the downstream direction.

In the last embodiment, the at least one guide device runs diagonally to the longitudinal axis of the burner tube, where areas of the at least one guide device lying radially inward are located at a greater distance from the open end of the burner tube than areas lying radially outward.

The fuel nozzle(s) is/are preferably designed to discharge fuel radially outward at a second angle at the end located downstream, in the direction of the at least one guide device, and during operation into the combustion chamber. In other words, during operation the fuel nozzle(s) discharge(s) fuel at or adjacent to the open end of the burner tube so that a stream or jet of fuel results which, starting from areas of the burner tube lying radially inward, runs diagonally outward to areas of the burner tube lying radially further outward where it is discharged at the at least one guide device and/or, if present, through the interspaces between the several guide devices into the combustion chamber.

The at least one guide device can comprise a ring or a disc with a central opening at the end located downstream. This embodiment can be achieved by a guide device designed as an independent component, with a baffle plate, described in what follows, performing at least partly the function of the guide device.

As an alternative, or in addition, several guide devices can be provided which are spaced at least partly from each other in such a way that interspaces are formed between the guide devices.

In accordance with one embodiment, the or each guide device can comprise a surface against which the fuel discharged from the fuel nozzles can flow. These surfaces in particular can be delta-shaped.

Preferably the fuel nozzle(s) is/are designed to discharge fuel at the second angle and toward the at least one guide device and/or toward the interspaces between guide devices. This can be achieved, for example, by an arrangement of the fuel nozzles angled to the longitudinal axis of the burner tube, or rather to its radial direction, at the open end of the burner tube and/or by suitably directed orifices of the fuel nozzles.

In accordance with a preferred embodiment, the fuel nozzles are suitable for discharging gaseous fuel. However, provision is also made for discharging liquid fuel by means of at least one or more additional fuel nozzles.

Preferably several fuel nozzles are located at the open end of the burner tube, in each case between one of the interspaces between guide devices.

In accordance with one embodiment, the combustion head includes an annular disc which functions as a baffle plate. The disc is positioned at the open end of the burner tube and extends from the burner tube essentially radially inward, in particular perpendicular to the longitudinal axis of the burner tube.

In accordance with a preferred embodiment, the disc is configured to function at least partly as a guide device, in particular areas of the disc lying radially inward. Provision is also made for the disc as a whole to act as a guide device and perform the function of a baffle.

In accordance with a further embodiment, it is possible to design the disc as a separate component and to locate the at least one guide device on the disc. In the case of, for example, an annular guide device, the guide device can extend radially inward at the first angle from radially inward lying areas of the disc and in the downstream direction.

If several guide devices are used, they can be located in radially inward lying areas of the disc, in particular essentially directly on the inner circumference of the disc (i.e. at the edge of the disc bounding the opening of the annular disc), and extend from there radially inward at the first angle.

Depending on the application of the combustion head, for example in a firing plant for gaseous and liquid fuel, at least one additional fuel nozzle may be present. Preferably the at least one additional fuel nozzle is designed to discharge fuel in a spray radially outward at a spray angle (third angle) determined by the atomizer nozzle. In accordance with a further embodiment, when steam or air atomizer nozzles are used, the fuel is introduced in several streams at an angle to the burner tube axis radially outward between the guide devices. This has, for example, the advantage of being able to select the fuel supply as a function of the fuel in order to optimize its combustion.

If the fuel nozzles named above are provided for gaseous fuel, it is preferred that the at least one additional fuel nozzle discharges liquid fuel during operation. The at least one additional fuel nozzle may, however, be similarly designed to supply gaseous fuel. The same applies in the event that the above mentioned fuel nozzles are to supply liquid fuel.

Preferably the combustion head also has a swirl device, for example, in the form of a swirl body which is fixed or which can be moved in the longitudinal direction of the burner tube to swirl combustion air supplied through the burner tube, in particular its middle, central area, that is to impart a swirl momentum to said air. The intention is to locate the swirl device upstream from the fuel nozzles in the burner tube.

In accordance with a further preferred embodiment, the combustion head comprises a pilot burner or supporting burner. Using the pilot burner, combustion gases can be supplied which can provide pre-heating during operation up to initial ignition (without forming a flame front), whereby stabilization of the flame front located at a distance from the combustion head can be achieved. Preferably the pilot burner is located upstream from the fuel nozzles in the burner tube and, if present, also upstream from the swirl device.

The first angle is preferably in a range between about 35° and 65°.

The second angle is preferably in a range between about 30° and 60°.

In the method in accordance with the invention, fuel is combusted by employing a combustion head which comprises a burner tube which has an open end located upstream which extends into a combustion chamber, and at least one guide device located at the downstream end which extends radially inward at a first angle. Explanations give above in reference to this apply equally here.

In the method in accordance with the invention, fuel is discharged at the downstream end radially outward at a second angle, toward the guide devices and into the combustion chamber.

Further, in the method in accordance with the invention, a flame front is generated at a distance downstream ahead of the combustion head, i.e. a "freely" self-stabilizing flame front is generated in the combustion chamber ahead of the combustion head.

The fuel is preferably discharged at the second angle toward the at least one guide device and/or, if present, toward interspaces between guide devices.

In accordance with one embodiment, it is preferred that the fuel is discharged in such a way that it mixes intensively with the combustion air and the recirculated gases downstream from the burner tube in the area of the guide devices. Only a small amount of excess air, which approaches the stoichiometric fuel-air ratio very closely, is required to operate the combustion head.

To stabilize the flame front, an initial combustion of fuel can be effected ahead of the flame front, by, for example, generating hot combustion gas by means of a pilot burner upstream from the fuel supply and introducing it into the root of the flame.

The fuel discharged at the second angle is preferably discharged ed in a range between about 30° and 60°.

In accordance with a further aspect, the present invention presents a method for combusting fuel using a combustion head with a burner tube extending partly into a combustion chamber, where a free flame front is generated in the combustion chamber located at a distance from the burner tube and downstream from said burner tube, and negative-pressure zones with turbulence areas are formed in the combustion chamber such that exhaust gases present in the combustion chamber are recirculated internally and mixed with fuel supplied through the burner tube at the downstream end radially outward at an angle in a downstream direction.

BRIEF DESCRIPTION OF THE FIGURES

In what follows, preferred embodiments of the present invention are described with reference to the attached figures.

DESCRIPTION OF PREFERRED EMBODIMENTS

Figure 1A:
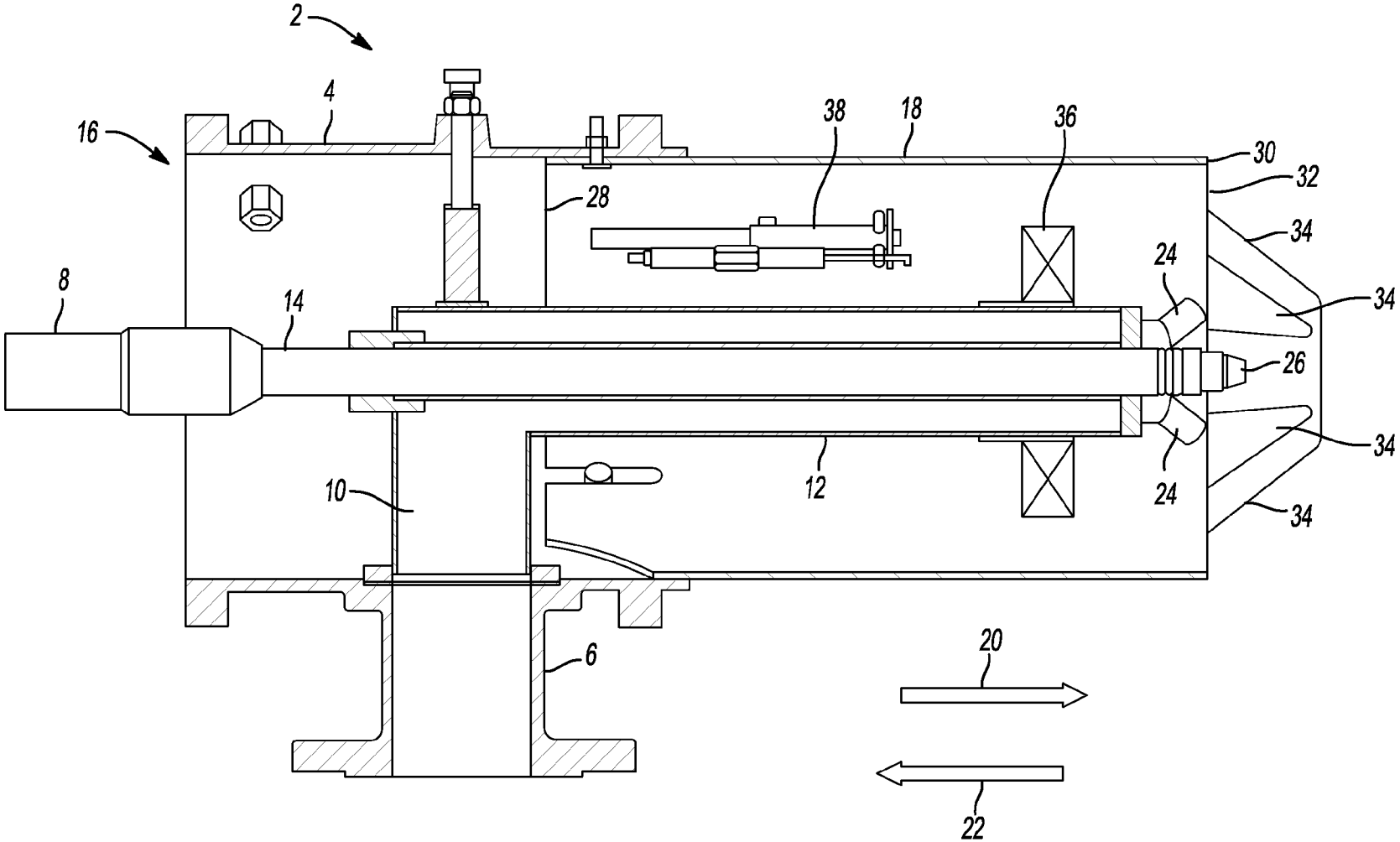
FIGS. 1*a* and 1*b* show schematic representations of a preferred embodiment of the present invention, in a sectioned view and as a view from the direction of the combustion chamber.
Figure 1B:
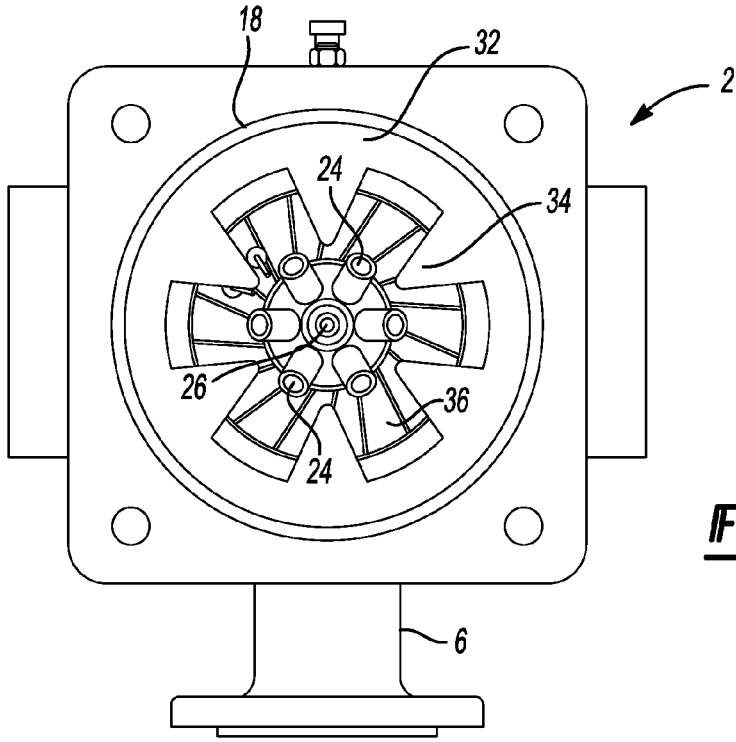

FIGS. 1*a* and 1*b* show schematic representations of a combustion head identified overall with 2.

The combustion head comprises a housing 4 with which the combustion head 2 can be connected, for example, to corresponding areas and/or components of a firing plant.

A first connection 6 is provided to supply gaseous fuels and a second connection 8 is provided to supply liquid fuels which can respectively be connected to corresponding sources of fuel to obtain fuel from same.

Gaseous fuel is supplied through the first connection 6 to a fuel gas tube 10 which comprises an area configured as a double jacket tube 12.

Liquid fuel is supplied through the second connection 8 to a fuel linkage 14 which is partly enclosed by the double jacket tube 12.

The fuel linkage 14 is moveable axially in the double jacket tube by an assist mechanism, e.g. a linear drive. When operating the combustion head with gaseous fuels, this fuel linkage and the fuel nozzle 26 connected to it can be retracted into the double jacket tube to prevent thermal overloading of the fuel nozzle.

At the end shown on the left in FIG. 1*a*, the housing 4 has an opening 16 through which combustion air can be supplied to the combustion head 2.

A burner tube 18 is connected at the opposite end of the housing 4 through which the double jacket tube 12 and the fuel nozzle linkage 14 extend, as can be seen in FIG. 1*a*.

Based on the supply of combustion air through the opening 16 and based on the way fuel is directed in the longitudinal direction of the combustion head 2 and especially of the burner tube 18, the direction indicated by the arrow 20 is described as downstream, while the direction indicated by the arrow 22 is described as upstream.

Fuel nozzles 24 are located at the downstream end of the double jacket tube 12. The fuel nozzles 24 are aligned diagonally in the downstream direction with reference to the longitudinal axis of the burner tube 18, in other words, extend radially outward at an angle. It is assumed that the alignment of the fuel nozzles 24 also determines the direction in which they discharge fuel. That means in the case of the embodiment shown here that the fuel nozzles 24 discharge fuel radially outward at an angle. This angle of fuel discharge can also be achieved, for example, by the double jacket tube 12 having fuel outlet orifices at its downstream end which allow fuel to be discharged radially outward at an angle, and/or, for example, by fuel being discharged at the downstream end of the double jacket tube 12 essentially in the longitudinal direction of the burner tube 18 and being deflected radially outward at an angle by deflection means.

The fuel nozzle linkage has an additional fuel nozzle 26 at its downstream end which can discharge fuel as a spray with different spray angles and profiles.

The burner tube 18 is open at its upstream end 28 in order to be able to receive combustion air supplied through the opening 16. An annular disc 32 is located at the downstream end 30 of the burner tube 18.

The disc 32 can also be described as a baffle plate since it backs up combustion air flowing in the downstream direction and, if present, fuel and deflects them to the middle of the downstream end 30 of the burner tube 18. Guide devices 34 are located at the inner edge of the baffle plate 32, which edge bounds the central opening of the burner tube. Regarding the manufacturing method, the burner tube 18, the disc 32 and the guide devices 34 can be prepared as separate components or configured in one piece.

Starting from the disc 32, the guide devices 34 extend diagonally inward in the downstream direction, in other words, radially inward at an angle and in the downstream direction. In the embodiment shown, the guide devices 34 are formed by delta-shaped, triangular surfaces.

The fuel nozzles 24 are designed and/or located such that they do not direct fuel directly onto the guide devices 34 but toward the interspaces between the guide devices 34.

Upstream from the fuel nozzles 24 and 26, a swirl device or a swirl body 36 is provided circumferentially on the double jacket tube 12. With the swirl device 36, a swirl momentum is imparted to combustion air supplied, or at least a portion of same (e.g. the middle, central area), so that an internal air stream swirl is generated downstream from the swirl device 36. The diameter of the swirl device 36 and the distance from the disc 32 affect the pulse ratio between the swirled combustion air and the unswirled air flowing between the swirl device 36 and the burner tube 18. The swirl device 36 is advantageously moveable in the longitudinal direction of the burner tube 18 so that by adjusting the swirl device 36 relative to the disc 32, or the guide devices 34, an optimized air stream swirl is generated with respect to the air stream and pressure ratios, which are described in what follows, upstream and downstream from the disc 32 and the guide device 34.

Particularly during operation with liquid fuel, the swirl momentum passes at least partly to the fuel spray emanating from the nozzle 26.

A pilot burner or support burner 38 is located upstream from the swirl device 36. The pilot burner 38 is used particularly in part-load operation in order to give off combustion gases which can provide heating up to initial ignition of fuels discharged by means of the fuel nozzles 24 and/or 26. This "pretreatment" of fuel in particular provides additional stabilization of a flame front located at a distance from the combustion head 2 and is described in more detail in what follows.

Figure 2:
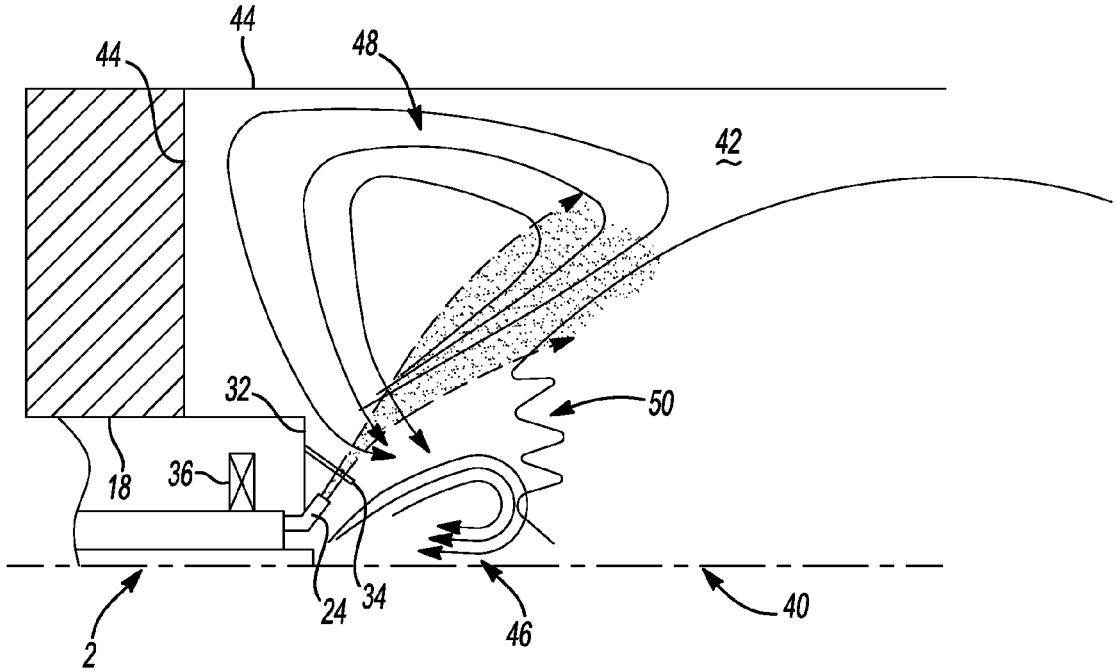
FIG. 2 shows a schematic representation of an operating state when using a combustion head in accordance with the invention.

One embodiment of the method in accordance with the invention and the operation of the combustion head in accordance with the invention are explained in greater detail in what follows with reference to FIG. 2.

FIG. 2 represents schematically the use of the combustion head 2 from FIGS. 1*a* and 1*b* in a firing plant indicated in FIG. 2. Because of the assumed rotationally symmetrical design of the firing plant, the combustion head 2 and the conditions arising during operation, FIG. 2 is a schematic sectional representation with respect to an axis of symmetry 40.

The combustion head 2, more precisely an area of the burner tube 18 located downstream, projects into a combustion chamber 42. The combustion chamber is bounded by walls 44.

In operation, the combustion air flowing against disc 32 and the guide devices 34 causes negative pressures zones with turbulence areas to be formed at the disc 32 and at the guide devices 34 on the downstream side, that is to say on the sides of the disc 32 and the guide devices 34 facing the combustion chamber 42. In particular, two counter-rotating vortices 46 and 48 form at each guide device 34 which can extend far into a flame front which forms downstream from the combustion head 2 and at a distance from same. The negative pressure zones and areas of turbulence, particularly the vortices 46 and 48, provide intensive internal recirculation of gases, or exhaust gases, present in the combustion chamber 42 which are created during the combustion of fuels supplied by means of the combustion head 2. Simultaneously, the areas of turbulence cause intensive mixing of recirculated combustion gases and fuel supplied.

In the case of the combustion head 2, the flame front 50 does not form immediately at the combustion head 2 itself, but at a distance from same, "freely" in the combustion chamber 42. The flame front 50 located at a distance from the combustion head 2 allows recirculated combustion gases and fuel supplied to be mixed, whereby flame temperature is reduced and nitrogen oxides created during combustion are reduced. Furthermore, the flame front 50 located at a distance from the combustion head 2 allows fuel to be prepared, which is explained in more detail in what follows.

Because of its exit momentum as well as the aforementioned negative pressure zones and areas of turbulence, fuel supplied by means of the fuel nozzles 24 and/or 26 (latter not shown in FIG. 2) reaches the areas of the combustion chamber 42 in which the vortex 48 is present. This area is described in what follows as the outer recirculation zone. In the outer recirculation zone, the result is heavy fuel enrichment, with an understoichiometric reductive atmosphere.

In the case of a liquid fuel, for example oil, fuel in the outer recirculation zone is already more strongly gasified compared with the prior art because recirculated exhaust gases are drawn in continuously at the end 30 of the burner tube 18 because of the negative pressure zones and the areas of turbulence on the downstream side of the disc 32 and the guide devices 34.

In general, but particularly in the case of gaseous fuel which is supplied by fuel nozzles 24, fuel is prepared and/or split in the outer recirculation zone surrounding the combustion head—in addition to the internal exhaust gas recirculation described above, in particular of inert combustion gases and their being mixed with fuel.

In detail, the result is that fuel molecules are split into radicals in the outer recirculation zone and fuel is at least partly oxidized.

Tests using a combustion head in accordance with the invention with an output of about 2,300 kW have provided the following results measured in areas around the combustion head:

| | |
|---|---|
| $CO_2$: | about 11.3% by volume |
| $O_2$: | about 0.1% by volume |
| CO: | more than about 1.0% by volume |
| $C_xH_y$: | about 0.05 . . . 0.1% by volume |

In the outer recirculation zone, therefore, there is a mixture with low oxygen content and high carbon monoxide (CO) charge and unburned carbohydrates ($C_xH_y$). At least partly higher $CO_2$ readings were found than in, or behind, the flame at the end of the combustion chamber. Overall, these and additional tests are evidence of a preparation and/or splitting of fuel in the outer recirculation zone.

The resulting radicals formed—mixed with exhaust gases from the flame—are least partly inducted by the combustion head 2. The radicals are highly reactive and ignite at least partly downstream from the combustion head 2 in areas in which recirculated combustion gas mixes with combustion air supplied at the end located upstream from the combustion head 2. As a result, the partial oxygen pressure of the combustion air is additionally lowered to charge the combustion air stream with recirculated inert combustion gases before the mixture of combustion air and recirculated combustion gases can mix with fuel and ignite. The radicals and interim reaction products created in the preparation and/or splitting of fuel (e.g. CH, HCH, $CH_3$, OH and CO) represent unstable interim reaction products inside flames. In comparison, it is advantageous not to split stable methanol molecules ($CH_4$), for example, into interim reaction products for combustion until the products of combustion (e.g. $CO_2$, $H_2O$) are formed by completing the combustion process.

Splitting of this kind of stable components (e.g. methanol molecules) into radicals and a related oxidation process begins with an endothermic reaction, for example:

$$CH4 \rightarrow CH3+H \text{(with for example about } -38 \text{ kJ/mol)}$$

For this reason, combustion of the combustible components diluted with recirculated inert combustion gases proceeds slowly enough downstream from the combustion head 2 on the one hand to prevent the formation of areas with high (combustion) temperatures. On the other hand, this combustion proceeds quickly enough to stabilize the flame front 50, located at a distance from the combustion head 2, thermally by oxidation heat and to lower the oxygen partial pressure of the mixture of combustion air and recirculated combustion exhaust gas by the binding of oxygen for the oxidation of the radicals and partly burned components (in particular partly burned gases).

Through the induction of inert gases and radicals, or partly burned gases respectively, in the negative pressure zones of the guide devices 34 and the disc 32, only a small amount of energy is required to mix the media streams thoroughly because the mixing process is carried out at least partly before the start of the combustion process—and thus in a comparatively cold zone. In this zone the media streams have a low viscosity. The viscosity of air and exhaust gas is known to rise sharply with temperature so that the mixing of exhaust gases directly into the flame area would make considerably higher mixing energy necessary.

The percentage of reductive CO in the recirculated combustion exhaust gas prevents the propagation of a hot flame formation because CO, compared with methane, has a lower laminar flame velocity. The flame temperature is additionally reduced, whereby the quantity of nitrogen oxides created during combustion can be kept to a low level. This is confirmed by tests in which very low amounts of nitrogen oxides were measured even at high combustion chamber pressure—which are clearly lower than those of the known processes. Furthermore, combustion proceeds more stably compared with known approaches, in particular the pulsations generally customary at high recirculation rates of combustion exhaust gases are missing.

The explanations above with respect to the outer recirculation zone also apply to the areas in the combustion chamber 42 in which the vortex 46 forms. These areas are described in what follows as the inner recirculation zone.

There, in particular in the area between the combustion head 2 and the flame front 50, the crossing of the media streams is extremely effective. While the fuel flows through the fuel nozzles 24 and/or 26 at an angle in a radial direction from the longitudinal axis of the combustion head 2 to the outer recirculation zone, recirculated combustion exhaust gas is diverted essentially through the array of guide devices 34 into the core zone of the flame in the vicinity of the flame axis. This creates a fuel-preparation mechanism internal to the combustion chamber which spatially separates the formation and oxidation of radicals. As mentioned above, the result is (thermal) preparation of fuel in the recirculation zone, or zones, around the combustion head which are formed by the combustion chamber walls 44, the combustion head 2 and the flame front 50, in addition to the recirculation of exhaust gases from the flame.

The present invention, compared with the prior art, allows a further reduction of nitrogen oxides in exhaust gases from firing plants, achieved in particular with gas, heating oil and multi-fuel burners, through the preparation of fuel described above and/or fuel splitting in particular into radicals in the areas into which combustion gases are recirculated to interact with fuel supplied.

Furthermore, the present invention improves the stability of the "free" flame front, particularly when a pilot burner is used in part-load operation to achieve pre-heating up to the point of initial ignition of fuel.

In the case of liquid fuel, the present invention additionally reduces the formation of soot, particularly in the areas into which combustion gases from the combustion chamber are recirculated because the re-induction and/or mixing in of the combustion gases takes place continuously at the inner edge of the disc 32 and additionally at the edges of the guide devices 34. The pre-gasification of the fuel spray is thereby considerably improved and the mixing of the recirculated gases with combustion air is intensified.

What is claimed is:

1. A combustion head for combusting fuel having a flame front downstream distanced from the combustion head, comprising:

a burner tube which has an open downstream end located downstream and intended for location in a combustion chamber, at least one guide device positioned at the downstream end, the at least one guide device extending beyond the downstream end of the burner tube and extending radially inward at an angle, and at least one fuel nozzle provided in or at the burner tube, the at least one fuel nozzle positioned and configured to discharge fuel at the downstream end radially outward at a second angle in the downstream direction, the at least one fuel nozzle directed directly at the open downstream end and toward the at least one guide device into the combustion chamber.

2. The combustion head of claim 1, wherein several guide devices which are spaced apart from each other extend radially inward at the first angle and in a downstream direction.

3. The combustion head of claim 2, wherein each of the guide elements has a delta-shaped surface.

4. The combustion head of claim 1, wherein the at least one guide device extends radially inward and in a direction perpendicular to the burner tube axis.

5. The combustion head of claim 1, wherein the at least one guide device comprises a closed ring which extends radially inward at the first angle.

6. The combustion head of claim 1, wherein the several guide devices comprise areas which are spaced apart from one another and form interspaces.

7. The combustion head of claim 6, wherein each fuel nozzle is designed to discharge fuel at the second angle toward the interspaces between the guide devices.

8. The combustion head of claim 5, wherein each of the fuel nozzles is located between one of the interspaces between the guide elements.

9. The combustion head of claim 1, wherein each fuel nozzle is designed to discharge gaseous fuel.

10. The combustion head of claim 1 having a ring-shaped disc which extends radially inward from the downstream end.

11. The combustion head of claim 10, wherein the at least one guide element extends radially inward at the first angle from the inner circumference of the disc.

12. The combustion head of claim 1, having an additional fuel nozzle which is designed to discharge fuel radially outward at a third angle in a downstream direction and toward the at least one guide element.

13. The combustion head of claim 12, wherein the additional fuel nozzle is designed to discharge liquid fuel.

14. The combustion head of claim 1, having a swirl device which is located upstream from the fuel nozzles in the burner tube.

15. The combustion head of claim 14, having a pilot burner which is located upstream from the fuel nozzle in the burner tube.

16. The combustion head of claim 15, wherein the swirl device is located downstream from the pilot burner.

17. The combustion head of claim 1, wherein the first angle is in a range between about 35° and 60°.

18. The combustion head of claim 1, wherein the second angle is in a range between about 30° and 60°.

19. A method for combusting fuel using a combustion head having a burner tube which has an open downstream end located downstream which extends into a combustion chamber and at least one guide device, which is located at the open downstream end, extends beyond the open downstream end of the burner tube and extends radially inward at a first angle, said method comprising the steps of:

discharging fuel at the open downstream end of the burner tube radially outward at a second angle in the downstream direction and directly toward the at least one guide device, which extends beyond the open downstream end of the burner tube, and into the combustion chamber, and generating a flame front at a distance downstream and ahead of the open downstream end of the combustion head.

20. The method of claim 19, wherein the fuel is discharged at the second angle toward interspaces between several guide elements which are spaced apart from each other and form interspaces.

21. The method of claim 19, wherein the fuel is discharged such that negative pressure zones having one or more turbulence areas are formed downstream from each guide element.

22. The method of claim 19, wherein the fuel is gaseous fuel.

23. The method of claim 19, wherein an additional fuel is to be discharged radially outward at a third angle in a downstream direction and toward the at least one guide device.

24. The method of claim 23, wherein the additional fuel is liquid fuel.

25. The method of claim 19, wherein combustion gas is generated upstream from the fuel supply, which effects an initial ignition of fuel ahead of the flame front to stabilize the flame front.

26. The method of claim 19, wherein the fuel discharged at the second angle is discharged in a range between about 30° and 60°.

27. A method for combusting fuel using a combustion head having a burner tube extending partly into a combustion chamber, said method comprising the steps of:

creating a free flame front in the combustion chamber spaced away from the burner tube and completely downstream from the tube, and forming negative pressure zones with turbulence areas such that exhaust gases present in the combustion chamber are recirculated internally and mixed with fuel which is supplied via the burner tube at the downstream end radially outward at an angle in a downstream direction, the fuel directed outside of the burner tube for combustion only outside of the burner tube and only in the combustion chamber.

28. The method of claim 27, wherein counter-rotating vortices are generated in the turbulence areas.

29. The method of claim 28, wherein in an outer recirculation zone comprising an outer vortex and an inner recirculation zone comprising an inner vortex, fuel enrichment with an understoichometric reductive atmosphere is created.

30. The method of claim 29, wherein molecules from the fuel are at least partly split into radicals and fuel is at least partly oxidized in the at least one recirculation zone.

31. The method of claim 29, wherein radicals are inducted together with recirculated exhaust gases from the combustion chamber using the combustion head at least partly.

32. The method of claim 31, wherein inducted radicals are at least partly ignited in areas in which recirculated exhaust gases from the combustion chamber mix with the combustion air supplied at the combustion head at an upstream end of said combustion head.

* * * * *

UNITED STATES PATENT AND TRADEMARK OFFICE

CERTIFICATE OF CORRECTION

PATENT NO. : 7,891,971 B2
APPLICATION NO. : 11/502501
DATED : February 22, 2011
INVENTOR(S) : Thomas Schmidt et al.

It is certified that error appears in the above-identified patent and that said Letters Patent is hereby corrected as shown below:

Column 4, line 30, “give” should be --given--.

Column 4, line 58, after “charged” delete “ed”.

Signed and Sealed this
Third Day of April, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,891,971 B2
APPLICATION NO. : 11/502501
DATED : February 22, 2011
INVENTOR(S) : Thomas Schmidt et al.

It is certified that error appears in the above-identified patent and that said Letters Patent is hereby corrected as shown below:

Column 4, line 30, “give” should be --given--.

Column 4, line 58, after “charged” delete “ed”.

Column 10, line 1 (Claim 8, line 1) “claim 5” should read --claim 6--.

This certificate supersedes the Certificate of Correction issued April 3, 2012.

Signed and Sealed this
First Day of May, 2012

David J. Kappos

David J. Kappos
*Director of the United States Patent and Trademark Office*